United States Patent [19]

O'Sullivan

[11] Patent Number: 4,556,184

[45] Date of Patent: Dec. 3, 1985

[54] EXTENDIBLE CEILING HOOK

[76] Inventor: Daniel J. O'Sullivan, 116-40 Park La. S., Kew Gardens, N.Y. 11418

[21] Appl. No.: 521,051

[22] Filed: Aug. 8, 1983

[51] Int. Cl.[4] ..... A47H 1/10

[52] U.S. Cl. ..... 248/330.1; 47/67; 242/107.4 R; 242/107.4 C; 248/320; 248/492

[58] Field of Search ..... 248/330.1, 329, 328, 248/327, 320, 317, 491, 492, 493; 242/107.4 R, 107.4 C; 47/67; 160/297, 304

[56] References Cited

U.S. PATENT DOCUMENTS

| | | | |
|---|---|---|---|
| 190,881 | 5/1877 | Lone | 242/107.4 R |
| 677,758 | 7/1901 | Coldwell et al. | 242/107.4 R |
| 885,172 | 4/1908 | Patrick | 242/107.4 R |
| 2,172,459 | 9/1939 | Smith | 160/297 |
| 3,740,123 | 6/1973 | Leitl | 248/492 |
| 4,187,996 | 2/1980 | Ehrlich | 248/330.1 |
| 4,466,475 | 8/1984 | Saito et al. | 160/297 |

*Primary Examiner*—Ramon S. Britts
*Assistant Examiner*—Ramon O. Ramirez
*Attorney, Agent, or Firm*—Stiefel, Gross, Kurland & Pavane

[57] ABSTRACT

An extendible ceiling hook comprises an apparatus for suspending a hanging plant at various distances from a ceiling for the purposes of ease of maintenance, appearance and the general well being of the plant. An extension line, wound on an extension spool inside the extendible ceiling hook may be reeled in or out or made to rest at a desired distance from the ceiling by raising or lowering the suspended plant pot in a controlled fashion. The suspended plant can also be easily rotated to any desired angle to fully exploit any available sunlight and further enhance its appearance.

5 Claims, 11 Drawing Figures

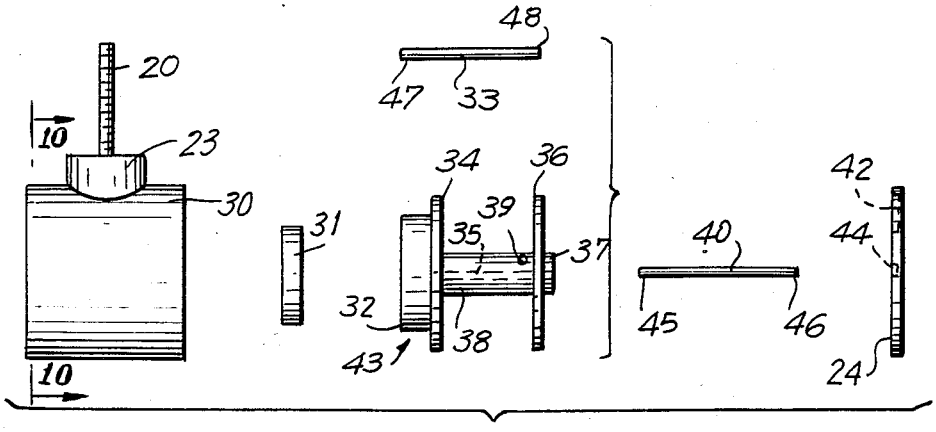
FIG. 4
FIG. 5
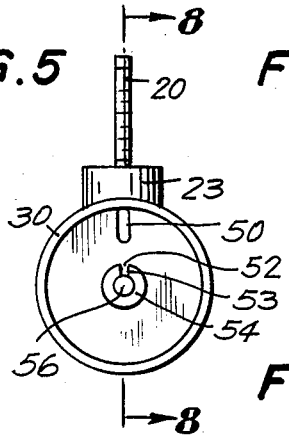
FIG. 6
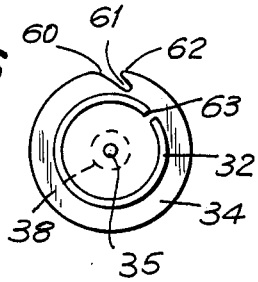
FIG. 7
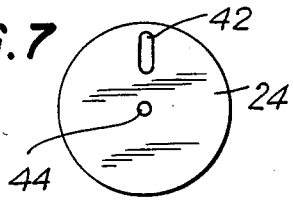
FIG. 9
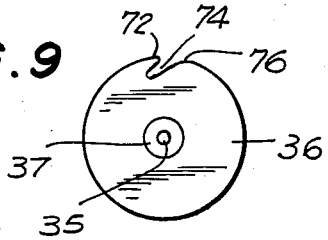
FIG. 10
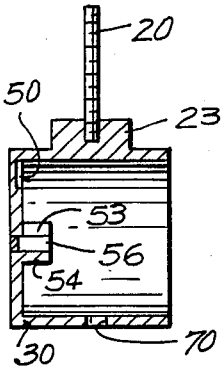
FIG. 8
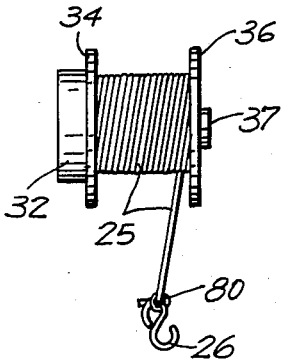
FIG. 11
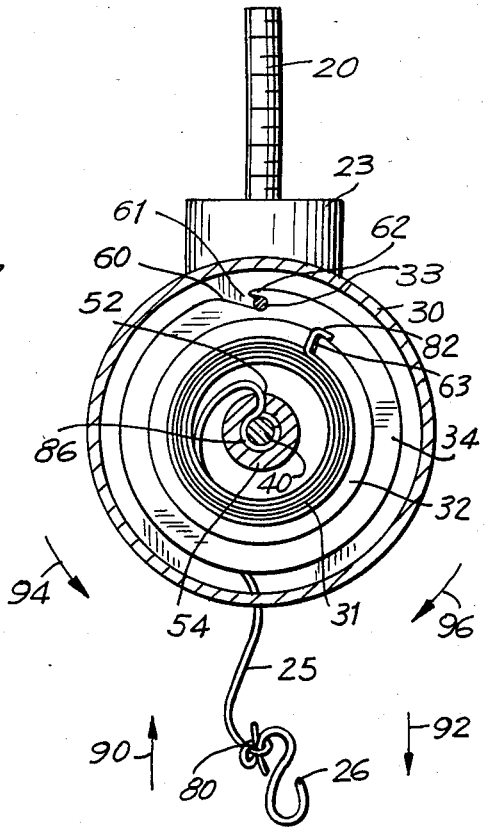

EXTENDIBLE CEILING HOOK

BACKGROUND OF THE INVENTION

This invention relates generally to fixtures such as are used to suspend plant pots from a ceiling.

It is well known that a variety of plastic and macrame type plant pots can be suspended by way of a hook secured to the ceiling. This however makes watering and general maintenance difficult since the plant is often too high off the ground to be easily reached. A further drawback is that existing ceiling hooks do not permit easy rotation of the plant, a feature necessary for even distribution of sunlight and the general well-being of the plant.

Finally, as a plant grows and matures its appearance may be enhanced by suspending it closer to or further away from the ceiling and rotating it so that it can be viewed from its most appealing side.

SUMMARY OF THE INVENTION

Therefore it is the principal object of the present invention to provide a way to suspend a plant pot from a ceiling in such a manner that the pot may be easily pulled down to a convenient level for maintenance.

A further object is that the plant pot may be suspended at any of a number of different levels from the ceiling to enhance beauty and exploit the available sunlight to its fullest.

A final object is to permit easy rotation of the plant pot to further enhance beauty and exposure to sunlight.

BRIEF DESCRIPTION OF THE DRAWINGS

Referring now to the drawings,

FIG. 4 is an exploded side view showing all of the components of the present invention.

FIG. 5 is a front view of the assembly housing of the present invention.

FIG. 6 is a front view of the extension spool of the present invention.

FIG. 7 is a front view of the assembly housing seal of the present invention.

FIG. 8 is a sectional view taken generally along the line 8—8 of FIG. 5.

FIG. 9 is a rear view of the extension spool of the present invention.

FIG. 10 is an enlarged sectional view taken generally along the line 10—10 of the assembly housing in FIG. 4 with all of the components of the invention in place.

FIG. 11 is a side view of the extension spool with the extension line and extension line grip in place.

DETAILED DESCRIPTION OF THE INVENTION

Figure 1:
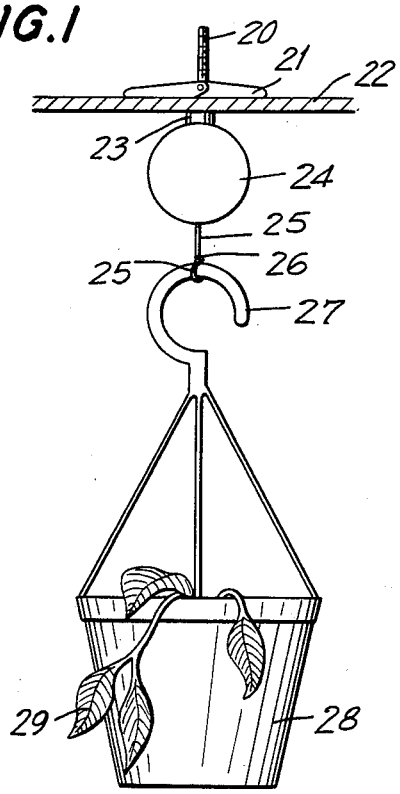
FIG. 1 is a front view of the present invention with a plant pot suspended close to the ceiling.
Figure 2:
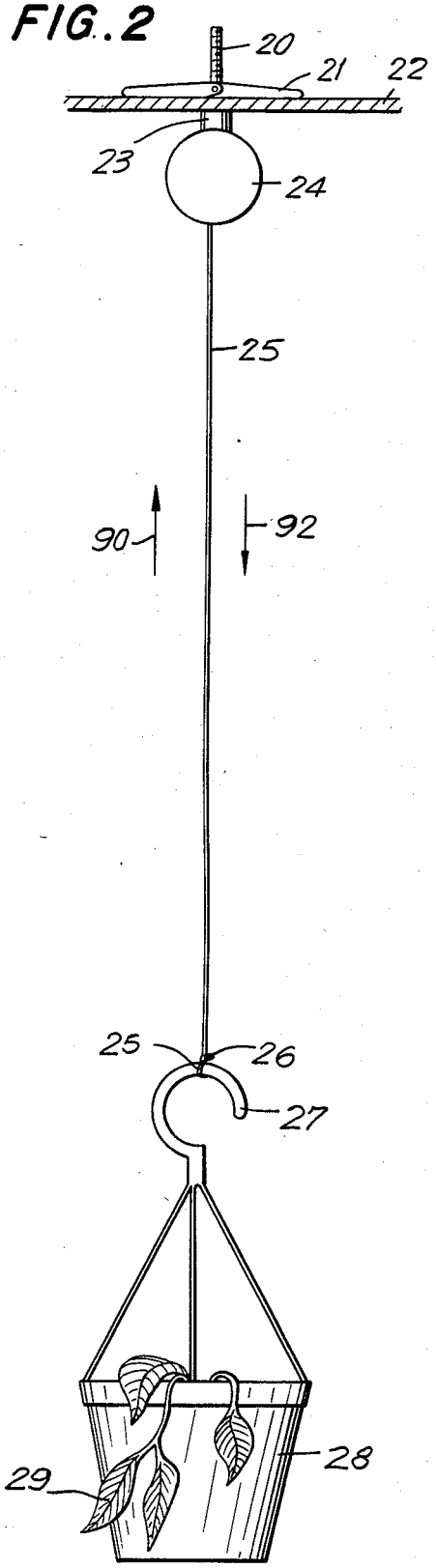
FIG. 2 is a front view of the present invention with the same plant pot suspended far from the ceiling.
Figure 3:
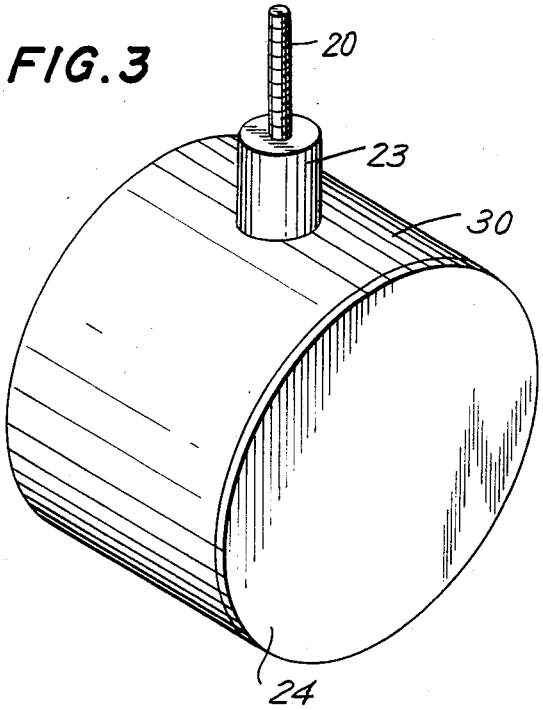
FIG. 3 is a perspective view of the present invention.

Referring now to FIGS. 1 through 3 I show a threaded securing shaft 20 inserted into a cross section of household ceiling 22 and held thereto by the standard leaf spring bracket 21. The assembly housing post 23 is pressed firmly against the cross section of household ceiling 22 when the extendible ceiling hook is screwed firmly in place. The assembly housing seal 24 is adhered to the assembly housing 30.

The extension line 25 is looped around the plant pot hook 27 and the extension line grip 26 is hooked onto the extension line 25 to form a secure loop on which the plant pot hook 27 rests. The plant 29 resides inside the plant pot 28.

When the plant pot 28 is raised slightly in the direction indicated by arrow 90 and then pulled rapidly downwards in the direction indicated by arrow 92 it can be made to rest in the position illustrated in FIG. 2 or any of several intermediate positions in between by a manner which will be explained below. Since the extension line 25 is made of a light gauge nylon or cord the plant pot 28 can be easily rotated to any desired angle.

Referring now to FIGS. 4 through 11 I show a hub 54 with left axle indentation 56 and notch 52 protruding from the assembly housing 30. The notch face 53 forms one side of the notch 52. The left guide 50 is a small indentation in the assembly housing 30.

The extension spool 43 consists of a reel 38 with thread hole 39 and axle shaft 35. The left wheel 34 has the left stop notch 61, the left smooth edge 60 and the left sharp edge 62 on its outer perimeter. The right wheel 36 has the right stop notch 74, the right smooth edge 76 and the right sharp edge 72 on its outer perimiter. The spring sleeve 32 with sleeve notch 63 is mounted coaxially to the left wheel 34. The friction hub 37 is mounted coaxially to the right wheel 36.

The extension line 25 is threaded through the thread hole 39, secured thereto by means of a knot and wrapped around the reel 38 in the manner illustrated in FIG. 11. The axle 40 is inserted into the axle shaft 35. The spring 31 is placed inside the spring sleeve 32 with the outer end 82 secured inside the sleeve notch 63. The inner end 86 is wrapped around the axle 40 as illustrated in FIG. 10. The stop rod 33 is then placed to rest between the left stop notch 61 and the right stop notch 74.

The extension line grip 26 is removed by untieing the knot 80 thus allowing the extension line 25 to be threaded through the line feed hole 70 in the assembly housing 30. Once threaded the extension line 25 is secured to the extension line grip 26 again by means of the knot 80 as illustrated in FIG. 10.

With the extension spool 43, extension line 25, spring 31, axle 40, extension line grip 26 and stop rod 33 thus assembled the entire combination is placed inside the assembly housing 30 so that the left side 45 of the axle 40 rests in the left axle indentation 56 and the inner end 86 of the spring 31 mates with the notch 52 as illustrated in FIG. 10. The left end 47 of the stop rod 33 rests loosely in the left guide 50 of the assembly housing 30.

The assembly housing seal 24 is then glued or press fit against the open side of the assembly housing 30 so that the right side 46 of the axle 40 rests inside the right axle indentation 44 and the right end 48 of the top rod 33 rests loosely inside the right guide 42. With the entire combination thus assembled I now refer to FIGS. 1 through 11 and in particular to FIG. 10 to explain fully the operation of the invention.

The spring 31 governs the rotation of the extension spool 43 upon the axle 40. The stop rod 33 rests loosely between the left guide 50 and the right guide 42 and upon the outer perimeters of the left wheel 34 and the right wheel 36.

FIG. 10 shows the stop rod 33 resting in the left stop notch 61 and the right stop notch 74. The weight of the plant pot 28 secured to the extension line 25 as in FIG. 2 exerts a force in the direction indicated by arrow 92 in FIG. 10. The stop rod 33 prevents the extension spool 43 from unwinding in the direction indicated by arrow 94 thus keeping the plant pot 28 at a fixed distance from the assembly housing 30. If the plant pot 28 is hand lifted in the direction of arrow 90 the spring 31 causes the extension spool 43 to rotate in the direction of arrow 96 thus allowing the stop rod 33 to be disengaged from the left stop notch 61 and the right stop notch 74 and placed upon the outer perimeters of the left wheel 34 and the right wheel 36.

A rapid pull of the extension line 25 in the direction of arrow 92 at this time will cause the stop rod 38 to ride the outer perimeters of the left wheel 34 and the right wheel 36 to the left smooth edge 60 and the right smooth edge 76. Due to the rapid motion of the extension spool 43 the stop rod 33 then moves over the left stop notch 61 and the right stop notch 74 to the left sharp edge 62 and the right sharp edge 72 at which time the stop rod 33 continues to ride the outer perimeters of the left wheel 34 and the right wheel 36 due to the continuing rapid rotation of the extension spool 43.

This happens for every rotation of the extension spool 43 in the direction of arrow 94 as long as said rotation is rapid. As soon as the pull in direction of arrow 92 is slowed down and the speed of rotation of the extension spool 43 in the direction of arrow 94 is consequently slowed down then the next encounter the stop rod 33 has with the left smooth edge 60 and the right smooth edge 76 will guide the stop rod 33 to rest again between the left stop notch 61 and the right stop notch 74 thus locking the extension line 25 and plant pot 28 at a new position from the assembly housing 30.

To return the plant pot 28 to the original position close to the assembly housing 30 the plant pot 28 is again hand lifted in the direction of arrow 90. This causes the spring 31 to rotate the extension spool 43 in the direction of arrow 96 thus reeling in the extension line 25. The extension line 25 is locked in position in the same manner as described above.

It can be seen that each rotation of the extension spool 43 offers a position at which the plant pot 28 can be locked. The total number of locking positions available is dependant on the length of the extension line 25, the number of turns on the spring 31 and the diameter of the reel 38. The assembly housing 30, extension spool 43 and assembly housing seal 24 can be of durable plastic or a metal alloy and the axle 40, stop rod 33, extension line grip 26 and threaded securing shaft 20 can be of steel, brass or other suitable strong metal. The extension line 25 can be of light gauge nylon, cord, catgut or other strong material.

While certain novel features of this invention have been shown and described and are pointed out in the annexed claims, it will be understood that various omissions, substitutions and changes in the forms and details of the device illustrated and in its operation can be made those skilled in the art without departing from the spirit of the invention. For example, more than one stop rod 33 may be provided to increase the total number of locking positions available.

I believe the nature of my invention, its purpose and its operation will now be clearly understood.

I claim:

1. An extendible ceiling hook, comprising an extension spool rotatable upon an axle mounted inside an assembly housing sealed with an assembly housing seal, the rotation of said extension spool being governed by a spring; an extension line secured to said extension spool and wound around said extension spool, exiting from said assembly housing at an opening and with an extension line grip secured thereto at a point outside said assembly housing; a notch and stop bar arrangement inside said assembly housing which permits said extension spool to rotate with speed but prevents said extension spool from rotation in a direction which would allow said extension line to unwind from said extension spool when the rotational speed of said extension spool is slow; a securing shaft protruding from said assembly housing.

2. An extendible ceiling hook as recited in claim 1, wherein said spring includes a spiral portion having outer end anchored to said extension spool and inner end anchored to said axle and assembly housing.

3. An extendible ceiling hook as recited in claim 1, wherein said notch and stop bar arrangement is a plurality of notches cut in said extension spool and the stop bar is loosely mounted to said assembly housing and said assembly housing seal and parallel to said axle.

4. An extendible ceiling hook as recited in claim 1, wherein said notch is a plurality of notches.

5. An extension device comprising:

an extension spool rotatably mounted inside a housing for receiving an extension line secured to the extension spool and wound around the extension spool;

a spring connected to the housing and to the extension spool for biasing the rotation of the extension spool towards a direction that winds up the extension line when the extension line is secured to the spool; and notch and stop bar means connected to the housing and to the extension spool, which means permits the extension spool to rotate in either direction through 360° when the rotational speed of the extension spool is sufficiently fast, but prevents rotation through 360° when the rotational speed of the extension spool is sufficiently slow.

* * * * *